US005865858A

United States Patent [19]

Schrell et al.

[11] Patent Number: 5,865,858

[45] **Date of Patent: *Feb. 2, 1999**

[54] AMINATED CELLULOSIC SYNTHETIC FIBERS

[75] Inventors: Andreas Schrell, Frankfurt; Werner Hubert Russ, Flörsheim; Bernd Huber, Kelheim, all of Germany

[73] Assignee: Hoechst Aktiengesellschaft, Germany

[ * ] Notice: The term of this patent shall not extend beyond the expiration date of Pat. No. 5,542,955.

[21] Appl. No.: 963,683

[22] Filed: Oct. 31, 1997

Related U.S. Application Data

[62] Division of Ser. No. 378,600, Jan. 26, 1995, Pat. No. 5,684,141.

[30] Foreign Application Priority Data

Jan. 29, 1994 [DE] Germany ..... 44 02 711.7
Jun. 29, 1994 [DE] Germany ..... 44 22 758.2

[51] Int. Cl.[6] ..... D01F 2/06; C08B 15/06; D06P 3/66; D06P 1/38

[52] U.S. Cl. ..... 81/561; 8/538; 8/921; 106/162.2; 106/164; 264/78; 264/194

[58] Field of Search ..... 8/561, 538, 921; 106/164, 162.2; 264/78, 194

[56] References Cited

U.S. PATENT DOCUMENTS

| | | | |
|---|---|---|---|
| 3,305,377 | 2/1967 | Mahomed | 106/164 |
| 3,377,412 | 4/1968 | Franks | 264/78 |
| 3,472,840 | 10/1969 | Stone et al. . | |
| 3,608,045 | 9/1971 | Toms | 264/194 |
| 3,793,419 | 2/1974 | Steinlin | 264/78 |
| 4,464,523 | 8/1984 | Neigel et al. | 527/300 |
| 4,806,126 | 2/1989 | Stemberger | 8/543 |
| 4,988,365 | 1/1991 | Stemberger | 8/543 |
| 5,403,361 | 4/1995 | Schrell | 8/581 |
| 5,507,840 | 4/1996 | Schrell et al. | 8/532 |
| 5,542,955 | 8/1996 | Schrell | 8/561 |
| 5,575,821 | 11/1996 | Schrell et al. | 8/493 |

FOREIGN PATENT DOCUMENTS

| | | |
|---|---|---|
| 2084585 | 6/1993 | Canada . |
| 248010 | 12/1987 | European Pat. Off. . |
| 0 359 188 | 9/1990 | European Pat. Off. . |
| 509397 | 10/1992 | European Pat. Off. . |
| 513656 | 11/1992 | European Pat. Off. . |
| 546476 | 6/1993 | European Pat. Off. . |
| 5266800 | 10/1993 | European Pat. Off. . |

*Primary Examiner*—Nathan M. Nutter
*Attorney, Agent, or Firm*—Connolly & Hutz

[57] ABSTRACT

Aminated cellulosic synthetic fibers are produced by adding an amine-substituted cellulose derivative to a viscose or an alkali cellulose and spinning fibers by the viscose spinning process, or by adding said cellulose derivative to a cellulose solution and spinning fibers from said solution.

18 Claims, No Drawings

AMINATED CELLULOSIC SYNTHETIC FIBERS

This application is a divisional application of Ser. No. 08/378,600 which was filed Jan. 26, 1995 and will issue as U.S. Pat. No. 5,684,141 on Nov. 4, 1997

The present invention relates to aminated cellulosic synthetic fibers, processes for producing them, and their use.

Regenerated cellulose fibers (hereinafter also called viscose fibers) have essentially the same dyeing characteristics as cotton fibers. At present, the dyeing of natural or regenerated cellulosic fibers requires alkali-donating agents and also electrolytes in order that satisfactory fixation results may be obtained with reactive dyes. It is precisely these necessary additives which are unacceptable for ecologically improved dyeing processes. The future will therefore increasingly belong to regenerated cellulose fibers which were first converted without additional processing steps into modifications with a high affinity for dyes, i.e. modifications dyeable without salt and alkali. Fibers modified in this way resemble animal fibers, such as wool or silk, in their chemical behavior and can be dyed under neutral conditions with anionic dyes without further salt or alkali additions.

Modifications of viscose have already been described in the literature. U.S. Pat. No. 3,793,419 describes a process for producing viscose fibers having novel dyeing properties. However, the process is extremely complicated and uneconomical. In addition, polyamineamides are used, which severely alter the native character of the fiber. This is evident for example from the use of disperse dyes in the later dyeing. Similarly, U.S. Pat. No. 3,305,377 concerns "aminalized fibers". The additions are aminoethyl- and diethylaminocelluloses in high concentrations, the dyeing is done exclusively with acid dyes.

There is therefore a great need for a process which yields a viscose fiber which in respect of dyeing with reactive dyes has distinctly more affinity than conventional viscose fibers and which differs from the latter also in the desired properties, for example hand.

This object is surprisingly achieved by adding an amine-substituted cellulose derivative to a viscose or an alkali cellulose or to a cellulose solution.

The present invention provides aminated cellulosic synthetic fibers produced-by adding an amine-substituted cellulose derivative to a viscose or an alkali cellulose and spinning fibers by the viscose spinning process, or by adding said cellulose derivative to a cellulose solution and spinning fibers from said solution, wherein the amine-substituted cellulose derivatives are polymers of olefinically unsaturated amines with cellulose or with cellulose components; or the amine-substituted cellulose derivatives are reaction products of cellulose or cellulose components with amines of the formula (1a) or (1b)

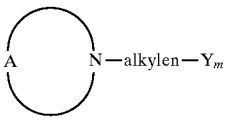

(1a)

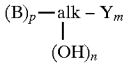

(1b)

where

Y is an ester group;

A and N together with 1 or 2 alkylene groups of 1 to 4 carbon atoms form the radical of a heterocyclic ring wherein A is an oxygen atom or a group of the formula (a), (b), or (c)

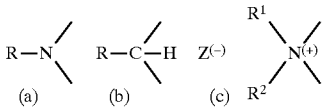

where

R is a hydrogen atom or an amino group or an alkyl group of 1 to 6 carbon atoms which may be substituted by 1 or 2 substituents selected from the group consisting of amino, sulfo, hydroxyl, sulfato, phosphate and carboxyl, or an alkyl group of 3 to 8 carbon atoms which is interrupted by 1 or 2 groups of the formulae —O— and —NH— or a combination thereof and may be substituted by an amino, sulfo, hydroxyl, sulfato or carboxyl group, $R^1$ is hydrogen, methyl or ethyl, $R^2$ is hydrogen, methyl or ethyl, and $Z^{(-)}$ is an anion;

B is an amino group of the formula $H_2N$— or an amino or ammonium group of the formula (d) or (e)

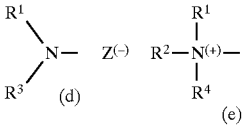

where $R^1{}_1$ $R^2$ and $z^{(-)}$ are each as defined above, $R^3$ is methyl or ethyl, and $R^4$ is hydrogen, methyl or ethyl;

p is 1 or 2; alkylen is a straight-chain or branched alkylene radical of 2 to 6 carbon atoms which may be substituted by 1 or 2 hydroxyl groups or is a straight-chain or branched alkylene radical of 3 to 8 carbon atoms which is interrupted by 1 or 2 groups of the formulae —O— and —NH— or a combination thereof;

alk is a straight-chain or branched alkylene radical of 2 to 6 carbon atoms or is a straight-chain or branched alkylene radical of 3 to 8 carbon atoms which is interrupted by 1 or 2 groups of the formulae —O— and —NH— or a combination thereof and is preferably a straight-chain or branched alkylene radical of 2 to 6 carbon atoms;

m is 1 or 2;

n is from 1 to 4;

the amino, hydroxyl and ester groups can be attached to a primary, secondary or tertiary carbon atom of the alkylene radical.

The polymers can be prepared by polymerizing

A) monomers or monomer mixtures from the group of the a) N-vinylimidazoles which can be substituted on the heterocyclic ring by up to three $C_1$–$C_{12}$-alkyl radicals and can be present in N-quaternized form or in salt form, b) five- to eight-membered N-vinyllactams which can be substituted on the ring by up to three $C_1$–$C_{12}$-alkyl radicals, c) dialkylaminoalkyl acrylates or methacrylates having in total up to 30 carbon atoms in the dialkylaminoalkyl radical, which can be present in N-quaternized form or in salt form, d) N-(dialkylaminoalkyl)-acrylamides or -methacrylamides having a total of up to 30 carbon atoms in the dialkylaminoalkyl radical, which can be present in N-quaternized form or in salt form, and e) diallyl-$C_1$–$C_{12}$-alkylamines or their salts or diallyldi($C_1$–$C_{12}$-alkyl)ammonium compounds, with or without further comonomers in addition to (A) comprising f) monoethylenically unsaturated $C_3$–$C_{10}$-carboxylic acids and their alkali metal, alkaline earth metal or ammonium salts, g) monoethylenically unsaturated $C_3$–$C_{10}$-carboxylic esters, and also h) compounds which contain at least two ethylenically unsaturated, nonconjugated double bonds in the molecule, in the presence of B) monosaccharides, oligosaccharides, polysaccharides, thermally or mechanically treated, oxidatively, hydrolytically or enzymatically degraded polysaccharides, oxidized hydrolytically or enzymatically degraded polysaccharides, chemically modified mono-, oligo- and polysaccharides or mixtures thereof in a weight ratio of (A):(B) of from (95 to 20):(5 to 80).

In many cases it has proved advantageous to use polymers wherein the monomers (A) comprise either each of the compounds (a), (c), (d) and (e) alone or mixtures of 5 to 95% by weight of compound (b) and 95 to 5% by weight of one or more of the monomers (a), (c), (d), (e), (f), (g) and (h), wherein (h) is present in an amount of not more than 5% by weight, based on the total amount of all monomers (A).

Good results are also obtained on using as amine-substituted cellulose derivatives polymers of N,N-diallyl-N,N-di($C_1$–$C_{12}$)-alkylammonium halides and cellulose. Here it has proved advantageous to use N,N-diallyl-N-methyl-N-dodecylammonium halide, N,N-diallyl-N-methyl-N-octylammonium halide, N,N-diallyl-N-methyl-N-decylammonium halide, N,N-diallyl-N,N-dimethylammonium halide, especially N,N-diallyl-N,N-dimethylammonium chloride.

Of particular suitability are amino-containing compounds wherein the ester group is a sulfato or phosphato group or is a $C_1$–$C_4$-alkanoyl group, a phenylsulfonyloxy group or a phenylsulfonyloxy group substituted in the benzene nucleus by substituents selected from the group consisting of carboxyl, $C_1$–$C_4$-alkyl, $C_1$–$C_4$-alkoxy and nitro.

Suitable amines are in particular the compounds N-(β-sulfatoethyl)piperazine, N-[β-(β'-sulfatoethoxy)ethyl]piperazine, N-(γ-sulfato-β-hydroxypropyl)piperidine, N-(γ-sulfato-β-hydroxypropyl)pyrrolidine, N-(β-sulfatoethyl)piperidine, 2-sulfato-3-hydroxy-1-aminopropane, 3-sulfato-2-hydroxy-1-aminopropane, 1-sulfato-3-hydroxy-2-aminopropane, 3-hydroxy-1-sulfato-2-aminopropane, 2,3-disulfato-1-aminopropane or 1,3-disulfato-2-aminopropane or a derivative of these compounds with one of the ester groups mentioned above instead of the sulfato group or N-(2-sulfatoethyl)piperazine sulfate.

Also suitable for modifying and producing the amine-substituted cellulose derivatives are compounds with α-chloro-β-hydroxy or epoxy substitution as the reactive radical on the amino component. Reactive for the purposes of the present invention further includes in general those moieties which are capable of reaction with hydroxyl groups, for example of cellulose, or amino and thiol groups, for example of wool and silk, and of entering a covalent chemical bond.

Suitable cellulose components for producing the amine-substituted cellulose derivatives are carboxymethylcellulose, hydroxyethylcellulose, hydroxypropylcellulose, carboxymethylhydroxyethylcellulose, sulfoethylcellulose, carboxymethylsulfoethylcellulose, hydroxypropylsulfoethylcellulose, hydroxyethylsulfoethylcellulose, methylsulfoethylcellulose or ethylsulfoethylcellulose.

The process for producing the aminated cellulosic synthetic fibers is carried out either by subjecting cellulose to alkaline digestion (alkali cellulose), by reaction with carbon disulfide, dissolving the xanthate in sodium hydroxide solution and mixing the resulting viscose spinning solution with the amine-substituted cellulose derivatives or by adding the amine-substituted cellulose derivatives directly to the alkali cellulose and then xanthating. Subsequent spinning into an acid spin bath produces the modified viscose fibers of the present invention.

The nitrogen-containing compounds used for the present process are incorporated in aqueous medium or advantageously also by means of emulsifiers into the viscose spinning solution and are highly compatible with the viscose. The amine-substituted cellulose derivative is added in an amount of 1 to 20%, preferably 1 to 12% by weight, based on the cellulose content of the spinning solution prior to precipitation and forming.

If the fibers of the present invention are produced by other customary processes for producing cellulosic fibers from solution which are known to the person skilled in the art, for example the cupro process, the lyocell process and the process involving low-substituted cellulose ethers, then the cellulose is dissolved in a suitable organic solvent, admixed with the amine-substituted cellulose derivative and the solution is directly spun into fibers. It is best to effect the addition directly prior to the spinning, in which case the mixing and homogeneous dispersion can be effected by known mixing systems with the aid of static or dynamic mixing systems. However, the addition can also take place in any desired earlier stage of producing the spinning solution.

The aminated celluloses used as additives have degrees of polymerization between 300 and 1000 anhydroglucose units and viscosities from 300 to 1500 mPas. The degree of polymerization should not be less than 300, since otherwise there is a danger that the ready-prepared aminated cellulose is washed out of the fiber after spinning. The ready-prepared cellulose derivatives used for producing the modified viscose are soluble in water or an aqueous alkali metal hydroxide solution and can thus be directly stirred into the spinning solution with good distribution. There is no deterioration in the filterability of the viscose compared with additive-free samples, so that no plugging of the spinneret is observed in the course of the spinning process. The forming of the viscose is carried out by customary and known methods, for example spinnerets, a subsequent precipitation bath, and with or without further aftertreatment baths.

The present invention also provides a process for producing a dyed or printed textile material composed of cellulosic synthetic fibers, which comprises adding an amine-substituted cellulose derivative to a viscose or an alkali cellulose and spinning fibers by the viscose spinning process, or by adding said cellulose derivative to a cellulose solution and spinning fibers from said solution, processing said fibers into a woven or knitted fabric and dyeing or printing said fabric with one or more reactive dyes in the absence of additional electrolyte salt or alkali.

The textile modified fiber material which is used in the dyeing process of the present invention can be present in all stages of processing, for instance as yarn, staple, slubbing and piece goods (fabrics).

The modified textile fiber materials are dyed according to the present invention analogously to known processes for dyeing and printing fiber materials with water-soluble textile dyes using the known temperature ranges and customary dyestuff quantities, except that the dyebaths, padding processes, print pastes and inkjet formulations require no addition of alkaline compounds as customary for fixing fiber-reactive dyes, nor customary additions of electrolyte salts. Dyeing or printing therefore takes place at a pH between 4.5 and 8.5 and, if commercial reactive dyes are used, in the presence of an electrolyte salt content of from 0.01 to 0.5% by weight, based on the dyeing solution. Without the amination of the cellulose fibers according to the present invention, this electrolyte content would be too low for a successful dyeing process by a factor of 20 to 1000.

Dyeing processes which can be used according to the present invention include for example the various exhaust processes, such as dyeing on the jigger or on the reel beck or dyeing from long or short liquor, dyeing in jet dyeing machines, dyeing by short-time pad-batch processes or by a pad-superheated steam fixation process. The dyeing processes which can be used according to the present invention also include the printing techniques, including inkjet printing and transfer printing.

The dyes which are used for dyeing the modified cellulose are generally anionic in nature. Of particular suitability are the fiber-reactive textile dyes which are capable of reacting with hydroxyl groups, for example of cellulose, or amino and thiol groups, for example of wool and silk, of synthetic polymers, such as polyamides, or else modified polymers, precisely the aminated celluloses, to form a covalent bond. Suitable fiber-reactive components on the textile dyes include in particular sulfatoethylsulfonyl, vinylsulfonyl, chlorotriazinyl, fluorotriazinyl and also combinations thereof. In the examples which follow, parts are by weight unless otherwise stated.

EXAMPLE 1

A customary spinning viscose having a cellulose content of 8.9%, an alkali content of 5% and a viscosity of 38 falling ball seconds at 30° C. is admixed with a N-(2-sulfatoethyl) piperazine-modified hydroxyethylcellulose (viscosity 925 mPas, DP about 700) by stirring. This is done as follows. 16.2 parts of the modified hydroxyethylcellulose are pasted up with 49 parts of water and mixed with 436 parts of spinning viscose. This premix is stirred into 2522 parts of spinning viscose. After devolatilization, the spinning solution is spun by customary viscose spinning processes into a bath which contains sulfuric acid, sodium sulfate and zinc sulfate to form fibers, which are stretched in acid baths, cut, washed, spinfinished and dried. 10 parts of these dry viscose fibers are then admixed in a dyeing apparatus with 100 parts of water. The temperature is raised to 60° C. and a total of 0.1 part of a 50% strength electrolyte(predominantly sodium chloride)-containing dye powder of the formula, known from German Offenlegungsschrift 19 43 904

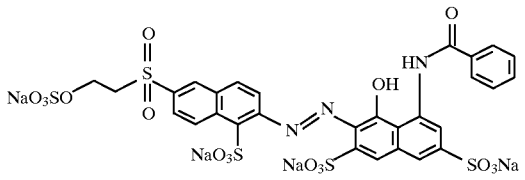

is metered in over a period of 30 minutes. Following a further liquor circulation period of 5 minutes the remaining liquor is dropped and the material is conventionally washed and dried. The result obtained is a strong and deep red dyeing having very good use fastness properties.

EXAMPLE 2

10 parts of the viscose fibers modified as described in Example 1 are transferred into a dyeing apparatus and treated in a liquor ratio of 10:1 with an aqueous liquor which, based on the weight of the dry fibers, contains in solution 0.1 part of a reactive dye of the formula, known from German Offenlegungsschrift 24 12 964

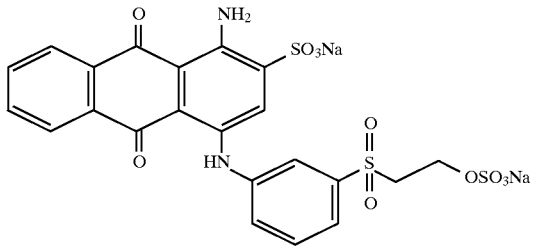

The fiber mixture is dyed at 80° C. for 30 minutes. The dyeing thus produced is further treated by rinsing and soaping in a conventional manner. The result obtained is a deep blue dyeing having the very good use fastness properties customary in the prior art.

EXAMPLE 3

A spinning viscose as described in Example 1 is admixed with a cellulose, modified in accordance with the directions for Example 1 of U.S. Pat. No. 4,464,523, having a nitrogen content of 2.9%, a viscosity of 825 mPas (2% strength solution in water) and a DP value of about 700. This is done in accordance with the directions of Example 1 of the present application. After devolatilization the spinning solution is spun by is customary viscose spinning processes into a bath containing sulfuric acid, sodium sulfate and zinc sulfate to form fibers, which are stretched in acid baths, cut, washed, spinfinished and dried. Weaving thus gives a textile viscose fabric which can be further processed directly in a pad-dyeing process. For this the fabric has applied to it at 25° C. an aqueous dye solution which, per 1000 parts by volume, contains in solution 20 parts of the dye of the formula

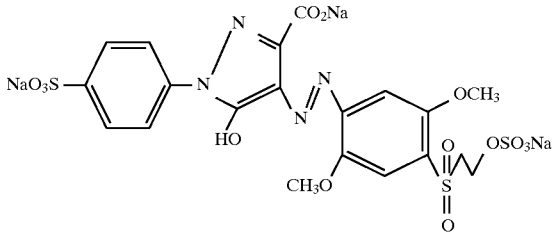

known from EP-A-0 158 233, Example 1, and 3 parts of a commercial nonionic wetting agent, by means of a pad-mangle to a liquor pickup of 80%, based on weight of fiber. The fabric padded with the dye solution is wound onto a batching roller, wrapped in plastic film, left at from 40° to 50° C. for 4 hours and then rinsed with cold and hot water, which may contain a commercial surfactant, and if necessary subsequently once more with cold water and dried. The result obtained is a strong level yellow dyeing which has good all round fastness properties, especially good rub and light fastness properties.

EXAMPLE 4

A spinning viscose as described in Example 1 is admixed with a potato starch modified in accordance with the directions of Example 28 of Offenlegungsschrift DE 41 25 752 A1. This is done in accordance with the directions of Example 1 of the present application.

After devolatilization, spinning, stretching, cutting, washing and drying the result obtained is a fiber which can be dyed by a conventional exhaust process. To this end 20 parts of the pretreated viscose fiber are treated in a dyeing apparatus with 200 parts of an aqueous liquor which, based on weight of fiber, contains 1.5% of the reactive dye of the formula

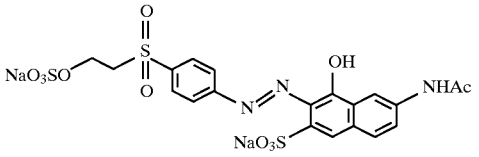

known from EP-A-0 061 151, Example 4, in commercial form and constitution. The fiber is dyed with this liquor at 80° C. for 30 min. The dyeing thus produced is further treated by rinsing and soaping in a conventional manner. The result obtained is a vivid orange dyeing having the good fastness properties customary for reactive dyes.

EXAMPLE 5

A spinning viscose as described in Example 1 is admixed with a hydroxyethylcellulose modified in accordance with the directions of Example 2 of DE-A-1 593 657. This is done in accordance with the directions of Example 1 of the present application.

Following further processing by the process steps customary for spinning viscose the result obtained is a fiber composed of modified viscose, which can be dyed in an exhaust process without salt and alkali additions. For this 30 parts of viscose yarn are wound onto a package and treated in a yarn dyeing apparatus which contains 450 parts (based on weight of fiber) of a liquor containing 0.6 part, based on the initial weight of the fiber, of an electrolyte-containing dye (predominantly sodium chloride-containing) of the formula

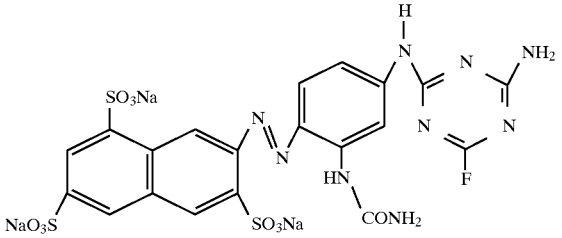

known from DE-A-28 40 380, Example 1, and heated to 80° C., the liquor being pumped alternately in to out and out to in. After 60 min at this temperature the liquor is dropped, and the dyeing obtained is rinsed and washed under the customary conditions. The result obtained is a level yellow fiber having the generally good fastness properties of reactive dyes.

FURTHER EXAMPLES

Example 5 is repeated using the reactive dyes listed hereinafter, which are applied by conventional processes but without alkali or salt additions. The results obtained are similar.

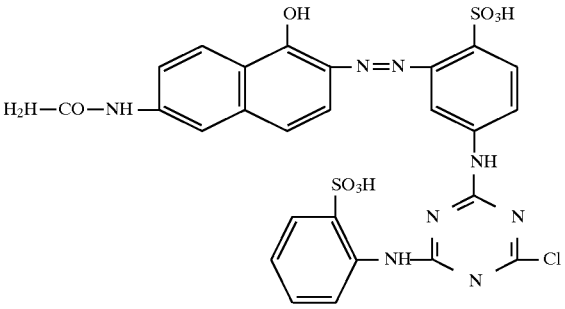

orange

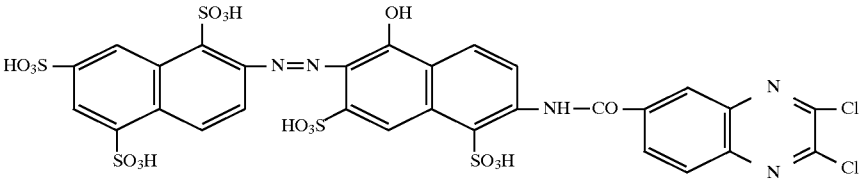

orange

-continued
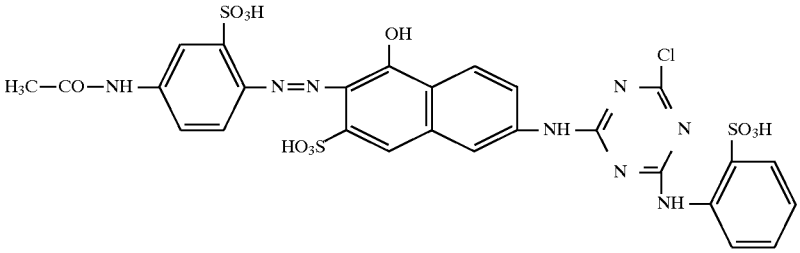
scarlet
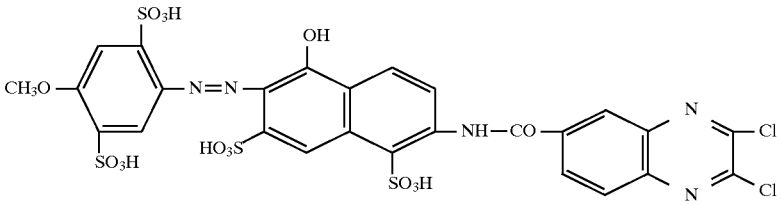
scarlet
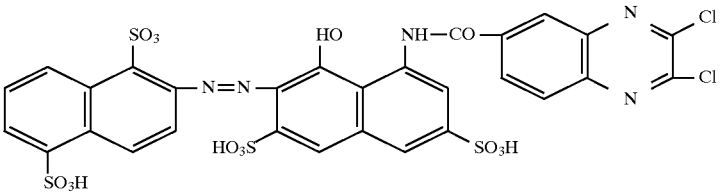
red
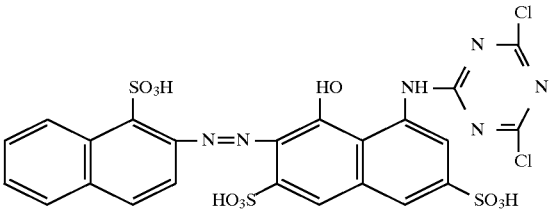
red
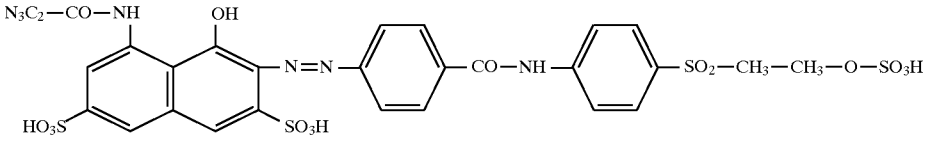
red
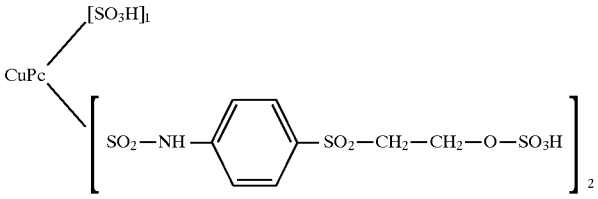
turquoise
CuPc = copper phthalocyanine
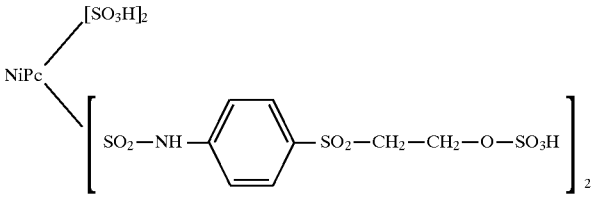
NiPc = nickel phthalocyanine -continued

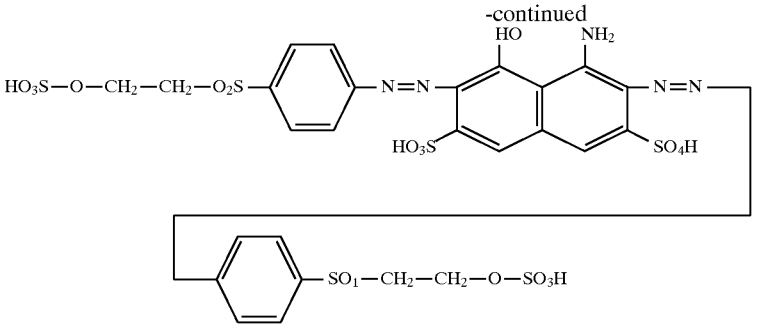

dark blue

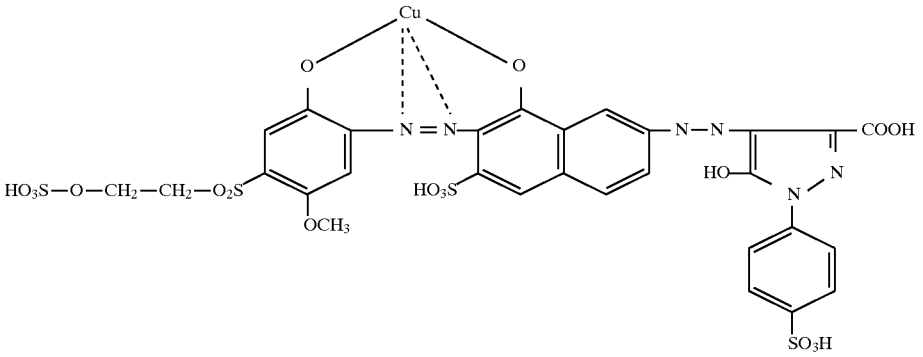

anthracite

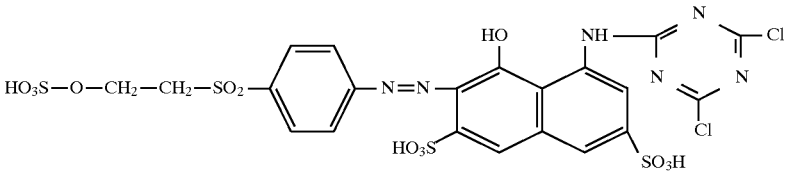

red

What is claimed is:

1. A process for producing a dyed or printed textile material composed of regenerated cellulose fibers, which comprises adding an amine-substituted cellulose derivative to a viscose or an alkali cellulose and spinning fibers by the viscose spinning process, or by adding said cellulose derivative to a cellulose solution and spinning fibers from said solution, processing said fibers into a woven or knitted fabric and dyeing or printing said fabric with one or more reactive dyes in the absence of additional electrolyte salt or alkali.

2. The process of claim 1 wherein the amine-substituted cellulose derivatives are polymers of A) and B) in a weight ratio of (A):(B) of from (95 to 20):(5 to 80) wherein A) comprises of at least one monomer selected from the group consisting a) N-vinylimidazoles which are optionally substituted on the heterocyclic ring by up to three $C_1$–$C_{12}$-alkyl radicals and are optionally present in N-quaternized form or in salt form, b) five- to eight-membered N-vinyllactams which are optionally substituted on the ring by up to three $C_1$–$C_{12}$-alkyl radicals, c) dialkylaminoalkyl acrylates or methacrylates having in total up to 30 carbon atoms in the dialkylaminoalkyl radical, which are optionally present in N-quaternized form or in salt form, d) (dialkylaminoalkyl) -acrylamides or -methacrylamides having a total of up to 30 carbon atoms in the dialkylaminoalkyl radical, which are optionally present in N-quanternized form or in the salt form, and e) diallyl-$C_1$–$C_{12}$-alkylamines or their salts or diallyldi ($C_1$–$C_{12}$-alkyl) ammonium compounds, with or without further comonomers in addition to (A) comprising f) monoethylenically unsaturated $C_3$–$C_{10}$-carboxylic acids and their alkali metal, alkaline earth metal or ammonium salts, g) monoethylenically unsaturated $C_3$–$C_{10}$-carboxylic esters, and h) compounds which contain at least two ethylenically unsaturated, nonconjured double bonds in the molecule, and B) monosaccharides, oligosaccharides, polysaccharides, thermally treated polysaccharides, mechanically treated polysacharides, oxidatively degraded polysaccharides, hydrolytically degraded polysaccharides enzymatically degraded polysaccharides, oxidized hydrolytically degraded polysaccharides, enzymatically degraded polysaccharides, chemically modified chemically modified monosaccharides, chemically modified oligosaccharides, chemically modified polysaccharides or mixtures thereof.

3. The process of claim 2, wherein, in said polymers, said monomers (A) comprise either each of the monomers (a), (c), (d) and (e) alone or mixtures of 5 to 95% by weight of monomer (b) and 95 to 5% by weight of one or more of the monomers (a), (c), (d), (e), (f), (g) and (h), wherein (h) is present in an amount of not more than 5% by weight, based on the total amount of all monomers (A).

4. The process of claim 1 wherein the amine-substituted cellulose derivatives are polymers of N,N-diallyl-N,N-di(C, -$C_1$–$C_{12}$)-alkylammonium halides and cellulose or cellulose components.

5. The process of claim 4, wherein the N, N-diallyl-N, N-di ($C_1$–$C_{12}$)-alkyl-ammonium halides are selected from the group consisting of N, N-diallyl-N-methyl-N-dodecylammonium halide, N, N-diallyl-N-methyl-N-dodecylammonium halide, N, N-diallyl-N-methyl-N-octylammonium halide, N,N,-diallyl-N-methyl-N-decylammonium halide, N,N-diallyl-N-methyl-N-decylammonium halide, and N, N-diallyl-N, N-dimethylammonium halide.

6. The process of claim 4 wherein the N,N-diallyl-N,N-di-($C_1$–$C_{12}$)-alkylammonium halide is N,N-diallyl-N,N-dimethylammonium chloride.

7. The process of claim 1 wherein the ester group Y is a sulfato, phosphato group, a $C_1$–$C_4$-alkanoyl group, a phenylsulfonyloxy group or a phenylsulfonyloxy group substituted in the benzene nucleus by substituents selected from the group consisting of carboxyl, $C_1$–$C_4$-alkyl, $C_1$–$C_4$-alkoxy and nitro.

8. The process of claim 1 wherein the amines contain a moiety with α-chloro-β-hydroxy or epoxy substitution.

9. The process of claim 1 wherein the cellulose component used for producing the amine-substituted cellulose derivatives is selected from the group consisting of carboxymethylcellulose, hydroxyethylcellulose, hydroxypropylcellulose, carboxymethylhydroxyethylcellulose, sulfoethylcellulose, carboxymethylsulfoethylcellulose, hydroxypropylsulfoethylcellulose, hydroxyethylsulfoethyl-cellulose, methylsulfoethylcellulose and ethylsulfoethylcellulose.

10. The process of claim 1 wherein the amine-substituted cellulose derivatives have degrees of polymerization between 300 and 1000 anhydroglucose units and viscosities from 300 to 1500 mPas.

11. The process of claim 1 wherein the regenerated cellulose fibers are spun by the cupro process or by the lyocell process.

12. The process of claim 1 wherein the amine-substituted cellulose derivative is added in a concentration of 1 to 20% by weight, based on the cellulose content of the spinning solution.

13. The process of claim 1 wherein the amine-substituted cellulose derivative is added in a concentration of 1 to 12% by weight, based on the cellulose content of the spinning solution.

14. The process of claim 1 wherein the textile material is dyed or printed at a pH of between 4.5 and 8.5.

15. The process as claimed in claim 14, wherein the amine-substituted cellulosic derivative is an amine-substituted saccharide.

16. The process as claimed in claim 15, wherein the saccharide is cellulose or starch.

17. The process of claim 1 wherein the amines are a compound selected from the group consisting of N-(β-sulfatoethyl) piperazine, N-(2-sulfatoethyl) piperazine sulfate, N-[β-(β-sulfatoethoxy) ethyl]piperazine, N-(γ-sulfato-β-hydroxypropyl) piperidine, N-(γ-sulfato-β-hydroxy-propyl) pyrrolidine, N-(β-sulfatoethyl) piperidine, 2-sulfato-3-hydroxy-1-aminopropane, 3-sulfato-2-hydroxy-1-aminopropane, 1-sulfato-3-hydroxy-2-amino-propane, 3-hydroxy-1-sulfato-2-aminopropane, 2,3-disulfato-1-aminopropane, 1,3-disulfato-2-aminopropane and a derivative of these compounds with a phosphato group, $C_1$–$C_4$-alkanoyl group, phenyl-sulfonyloxy group or with a phenylsulfonyloxy group substituted in the benzene nucleus by substituents selected from the group consisting of carboxyl, $C_1$–$C_4$-alkyl, $C_1$–$C_4$-alkoxy and nitro instead of the sulfato group.

18. A process for producing a dyed or printed textile material which comprises adding an amine-substituted saccharide to a viscose or an alkali cellulose and spinning fibers by a viscose spinning process, or by adding said amine-substituted saccharide to a cellulose solution and spinning fibers from said solution, processing said fibers into a woven or knitted fabric and dyeing or printing said fabric with one or more reactive dyes in the absence of additional electrolyte salt or alkali, wherein the amine-substituted saccharides are selected from the group consisting of polymers of olefinically unsaturated amines with saccharides and with cellulose components; or saccharides or cellulose components substituted with amines of the formula (1a) or (1b)

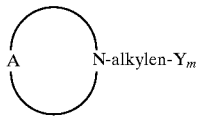

(1a)

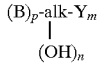

(1b)

where

Y is an ester group;

A and N together with 1 or 2 alkylene groups of 1 to 4 carbon atoms form the radical of a heterocylic ring wherein A is an oxygen atom or a group of the formula (a), (b), or (c)

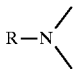

(a)

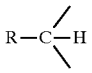

(b)

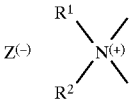

(c)

where

R is selected from the group consisting of a hydrogen atom; an amino group; an alkyl group of 1 to 6 carbon atoms which is optionally substituted by 1 or 2 substitutents selected from the group consisting of amino, sulfo, hydroxyl, sulfato, phosphato and carboxyl; and an alkyl group of 3 to 8 carbon atoms which is interrupted by 1 or 2 groups of the formulae —O—, —NH— or a combination thereof or is optionally substituted by an amino, sulfo, hydroxyl, sulfato or carboxyl group, $R^1$ is hydrogen, methyl or ethyl, $R^2$ is hydrogen, methyl or ethyl, and $Z^{(-)}$ is an anion;

B is selected from the group consisting of an amino group of the formula $H_2N$—, an amino, ammonium group of the formula (d) and ammonium group of the formula (e)

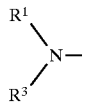

(d)

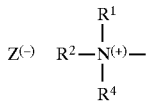

(e)

where $R^1$, $R^2$ and $Z^{(-)}$ are each as defined above, $R^3$ is methyl or ethyl, and $R^4$ is hydrogen, methyl or ethyl;

p is 1 or 2;

alkylene is selected from the group consisting of a straight-chain alkylene radical of 2 to 6 carbon atoms, which are optionally substituted by 1 or 2 hydroxyl groups, a branched alkylene radical of 2 to 6 carbon atoms which are optionally substituted by 1 or 2 hydroxyl groups, a straight-chain alkylene radical of 3 to 8 carbon atoms which is interrupted by 1 or 2 groups of the formulae —O— and —NH— and a combination thereof; and a branched alkylene radical of 3 to 8 carbon atoms which is interrupted by 1 or 2 groups of the formulae —O—, —NH— or a combination thereof;

alk is selected from the group consisting of a straight-chain alkylene radical of 2 to 6 carbon atoms, a branched alkylene radical of 2 to 6 carbon atoms, a straight chain alkylene radical of 3 to 8 carbon atoms which is interrupted by 1 or 2 groups of the formulae —O—, —NH— or a combination of —O— and —NH—, or a branched alkylene radical of 3 to 8 carbon atoms which is interrupted by 1 or 2 groups of the formulae —O—, —NH— or a combination of —O— and —NH—;

m is 1 or 2;

n is from 1 to 4; and the amino, hydroxyl and ester groups can be attached to a primary, secondary or tertiary carbon atom of the alkylene radical;

the saccharides being monosaccharides, oligosaccharides, polysaccharides, thermally or mechanically treated saccharides, oxidatively, hydrolytically, or enzymatically degraded polysaccharides, oxidized hydrolytically or enzymatically degraded polysaccharides, chemically modified mono-, oligo-, or polysaccharides, or mixtures thereof.

* * * * *